United States Patent [19]

Spiess et al.

[11] Patent Number: 5,071,177

[45] Date of Patent: Dec. 10, 1991

[54] LOCKING DEVICE FOR THE POSITIVE HOLDING OF A COVER OR GRATE IN A FRAME

[75] Inventors: Hansruedi Spiess, Delemont; Francois Galvanetto, Alle, both of Switzerland

[73] Assignee: Von Roll AG, Gerlafingen, Switzerland

[21] Appl. No.: 278,976

[22] Filed: Dec. 1, 1988

[30] Foreign Application Priority Data

Dec. 7, 1987 [CH] Switzerland ..... 4777/87

[51] Int. Cl.[5] ..... E05C 19/06

[52] U.S. Cl. ..... 292/91; 292/214; 404/25

[58] Field of Search ..... 292/214, 259, 260, 91; 411/552, 553, 349; 404/25

[56] References Cited

U.S. PATENT DOCUMENTS

| | | | |
|---|---|---|---|
| 148,102 | 3/1874 | Williamson et al. | 292/260 |
| 611,743 | 10/1898 | Stevens | 292/260 |
| 877,780 | 1/1908 | Klinsman | 292/260 |
| 911,256 | 2/1909 | McWane | 292/259 |
| 981,262 | 1/1911 | Heim | 292/259 |
| 1,220,296 | 3/1917 | Vanderford | 292/259 |
| 1,221,482 | 4/1917 | Sexton | 292/259 |
| 2,355,485 | 8/1944 | Tinnerman | 292/259 |
| 2,739,729 | 3/1956 | Jonas | 292/259 |
| 4,655,913 | 4/1987 | Boersma | 404/25 X |

FOREIGN PATENT DOCUMENTS

| | | | |
|---|---|---|---|
| 832757 | 1/1952 | Fed. Rep. of Germany | 292/260 |

*Primary Examiner*—Gary L. Smith
*Assistant Examiner*—Michael J. Milano
*Attorney, Agent, or Firm*—EGLI International

[57] ABSTRACT

In a cover-frame assembly for a manhole or the like a locking device is provided, which comprises a closing member having at least two horizontal arms and a mounting rod provided with a bearing and actuating device. The mounting rod and the bearing and actuating device are located in a bore having a widened bore portion, whereby a shoulder is formed, on which is supported a bearing surface of the bearing and actuating device. The ends of the arms each project into a guide link, which is shaped on the inner flange of the frame. The guide link has an inclined flank, by means of which the arms are increasingly elastically deformed. In the closed position of the locking device, the arms engage in locking recesses provided on the end of each inclined flank. This leads to a self-closure with pre-tension.

22 Claims, 2 Drawing Sheets

Fig. 1
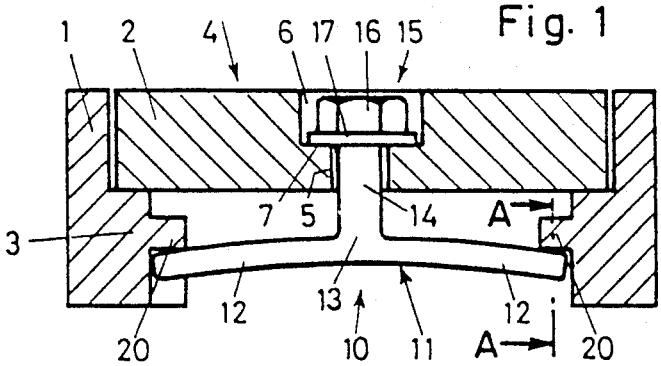
Fig.1a
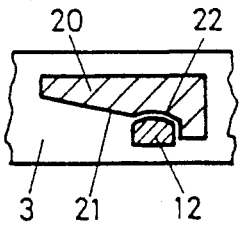
Fig. 2
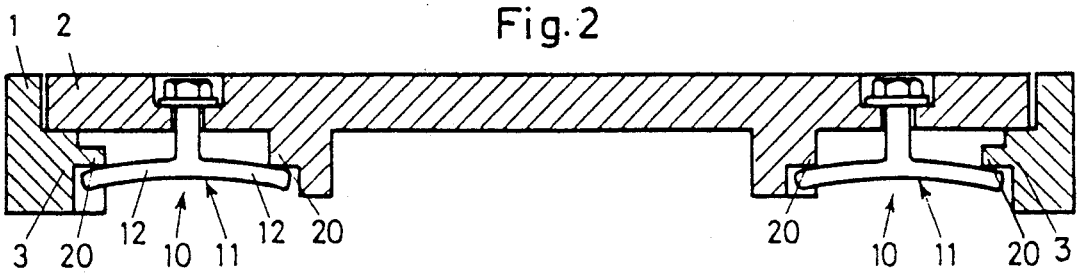
Fig. 4
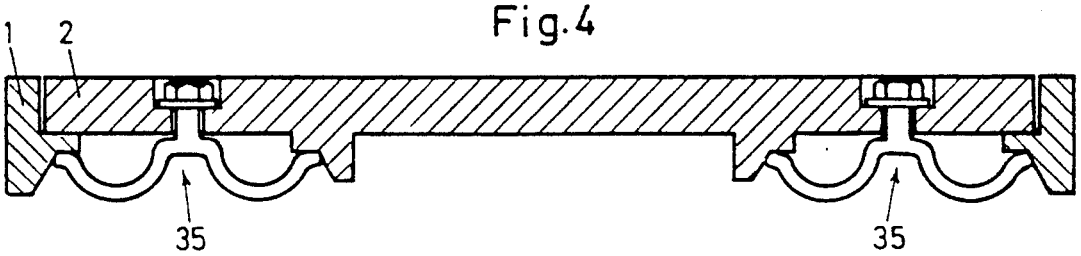
Fig. 3
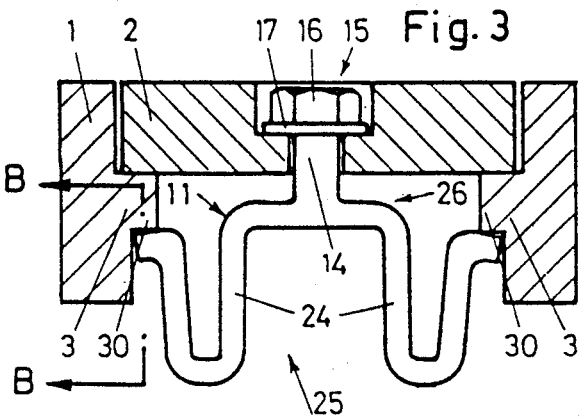
Fig. 5
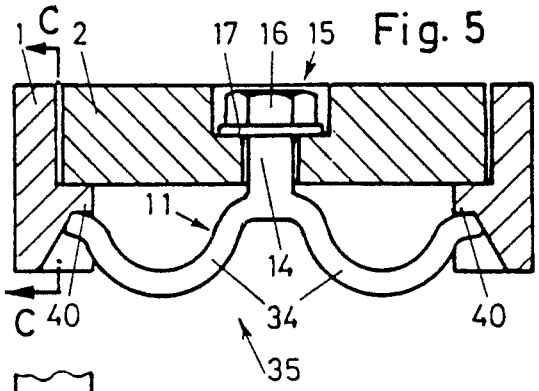
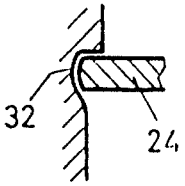
Fig.3a
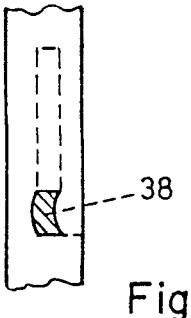
Fig.5a

LOCKING DEVICE FOR THE POSITIVE HOLDING OF A COVER OR GRATE IN A FRAME

BACKGROUND OF THE INVENTION

The present invention relates to a locking device, which is intended to positively hold or mount a cover or grate in a frame.

It is known to provide manholes and other ground openings with a covering, which essentially comprises a cover or grate, which is mounted in a frame. The term "frame" is not only understood to mean frame-like supports for the cover or grate, but also to define all edge or border constructions serving to mount the cover or grate. In the case of known constructions, one or more grates or covers are inserted in a frame and in general no device is provided for holding the cover in a frame. As hitherto the grates and covers have been given a relatively heavy construction, there was no particular need for holding same in the frame.

In order to save costs and materials, covers and grates have been constructionally improved and/or made from a highly loadable material, e.g. ductile cast iron in place of ordinary cast iron, which leads to a lighter structure. As such covers or grates have a higher elasticity, there is a need to provide mounts, with which the covers or grates are held in the frame.

In an earlier construction of a mount of the present applicant use has been made of a locking device insertable in the cover or grate and the parts of which cooperate with portions of the frame in such a way that with these portions and parts, is formed a positive or frictional engagement, optionally linked with a blocking possibility, so that there is a reliable mounting of the cover or grate, but whilst in part leaving a clearance. However, this earlier locking device is not able to hold the cover or grate in the frame with an initial stressing force.

SUMMARY OF THE INVENTION

It is therefore an object of the present invention to further develop a locking device of the aforementioned type so that the cover or grate is held in the frame with an initial stressing force.

According to the invention this and other objects are attained by a locking device including a closing member, which is provided with at least two interconnected arms, on the connecting point of which there is provided a bearing or mounting rod projecting from the arms and having a mounting and actuating device, the mounting rod being firmly connected to the arms. Thus, the arms can be used for pretensioning the cover in the frame.

The invention also covers a grate or cover and a frame, the function of which is to permit the pretensioning of the locking device according to the invention.

According to the invention the objects of the invention are also attained in that the closing member of the locking device is mounted in rotary manner with the mounting rod positioned in a bore formed in the cover or grate and held on a guide link in the cover or grate and/or frame by the ends of the arms, which results the formation of a form-locking connection or self-closure.

The invention is described in greater detail hereinafter relative to non-limitative embodiments and the attached drawings.

BRIEF DESCRIPTION OF THE DRAWINGS

FIG. 1 is a vertical sectional view of a cover firmly held in a frame by means of a locking device;

FIG 1*a* is a sectional view taken along line A—A of FIG. 1, showing the engagement of the arms of the locking device in the closed position;

FIG. 2 is a vertical sectional view through a cover in a frame, which is held in the frame by several locking devices;

FIG. 3 is a vertical sectional view through a cover mounted in a frame and which is held by a locking device of a second embodiment;

FIG. 3*a* is a sectional view on line B—B of FIG. 3, showing the engagement of the arms of the locking device in the closed position;

FIG. 4 is a vertical sectional view through a cover mounted in a frame and which is held by several locking devices according to the embodiment of FIG. 5;

FIG. 5 is a vertical sectional view through a cover mounted in a frame, which is held by a locking device of a third embodiment;

FIG. 5*a* is a sectional view on line C—C of FIG. 5, showing an engaging device of the arms in the closed position of the locking device; and FIGS. 6*a*–6*h* diagrammatically show variants of the first, second and third embodiments of a locking device.

DETAILED DESCRIPTION OF THE PREFERRED EMBODIMENTS

Figure 6A:
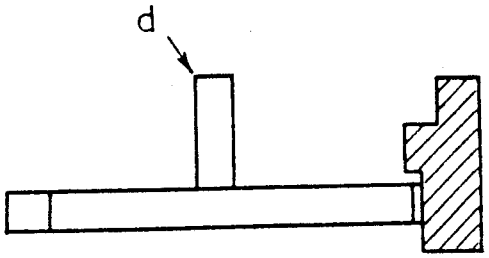

The present invention is based on the idea that the locking device should be constructed in such a way that an elastic deformation and therefore an initial stressing force can be produced thereon, so that the part to be secured is not only positively held in its mount, but can also be pressed onto the latter with an initial stressing force. FIG. 1 shows a first embodiment of a locking device. A frame 1 is placed over a not shown opening as a closing termination of the opening, in which is inserted a cover 2. Cover 2 is supported on an inner flange 3 of frame 1. Frame 1 and cover 2 are aligned with each other on a top surface 4, which conventionally forms the level of a not shown ground surface, in which the frame 1 with the cover 2 is installed.

In the center of the cover 2, which can have a random shape, e.g. circular, polygonal, rectangular or oval, there is provided a bore 5, which on the top of the cover merges into a widened bore portion 6, a circular shoulder 7 being formed between the latter and the bore 5.

For securing the cover 2 in frame 1 there is provided a locking device 10, which has a closing member 11 including two substantially horizontal arms 12. There can be more than two arms 12, e.g. three or four arms. Each arm has an end which merges into a connecting point 13 so that the arms are firmly interconnected. A substantially vertical bearing or mounting rod 14 is integrally formed with the arms 12 on the free end of the mounting. Rod 14 extends substantially perpendicular to arms 12. Rod 14 is arranged a bearing and actuating device 15, which is constructed as a head 16. Head 16 e.g. has a hexagonal shape, on which can be mounted a hexagon spanner, which enables the locking device 10 to be turned. The underside of head 16 is constructed as a bearing surface, which is located on shoulder 7 between bore 5 and the extended bore portion 6.

On the inner flange 3 of frame 1 there are located two guide links or projections 20 which, as can be gathered from FIG. 1*a*, have each an inclined flank or side 21. At the end of inclined flank 21 is provided a locking recess 22, in which arm 12 engages when the locking device 10 is in the closed position. As can be gathered from FIG. 1, during their rotary movement along the inclined flanks 21, arms 12 are elastically bent and consequently exert an initial stressing force on cover 2, which is consequently immovably pressed onto the inner flange 3, so that even when loaded by greatly varying loads, it is not displaced from its position. If more than two arms 12 are provided in closing member 11, there is also an increase in the number of guide links 20, one such link 20 being provided for each arm 12.

The covering formed from frame 1 and cover 2 in FIG. 1 has a relatively small diameter. Therefore cover 2 can be pressed onto inner flange 3 by a single locking device 10.

FIG. 2 shows a cover 2 with a relatively large surface, as is required for manholes and for openings into and out of which it is necessary to climb. As a function of the size of the cover, in this case there are appropriately provided three, four or more locking devices 10, whereof two are shown in FIG. 2. They are constructed in precisely the same way as the locking device 10 according to FIG. 1 and will therefore not be described in detail again. Arms 12 of closing member 11 are also elastically bent in guide links 20. However, the distinction of this embodiment is that not all arms 12 are supported on inner flange 3, as in the embodiment of FIG. 1, but instead parts of the arms are supported on guide links 20, which are shaped to engage onto the inside of cover 2. However, here again, the pressing of the cover onto the inner flange 3 is reliably obtained.

FIG. 3 shows a second embodiment of the locking device designated at 25. In place of straight arms, closing member 26 has arms 24 formed in a coil-like or U-shaped manner. The ends of the arms 24 are guided each on a guide link 30 of inner flange 3. Guide link 30 is constructed as an internally circumferential circular surface with a downwardly reducing diameter. This means that on turning of the locking device 25 into its closed position, arms 24 of closing member 26 are compressed and consequently elastically deformed. This once again leads to an initial stress in the locking device 25, so that cover 2 is held in frame 1. In the end position, i.e. in the closed position of the locking device 25, each of arms 24 also engages in a locking recess 32 of FIG. 3*a*.

A third embodiment of a locking device 35 is shown in FIG. 5. Unlike arms 12 and 24 of FIGS. 1 and 3, arms 34 are arcuately bent and are guided each on a guide link 40. In this case the guide link 40 is constructed in such a way that, on the one hand, there is a compression of the arms 34, as in the embodiment of FIG. 3, and, on the other hand, there is an elastic bending similar to that of the embodiment of FIG. 2. In the embodiment according to FIG. 5, there is once again provided a locking recess 38, cf. FIG. 5*a*. The locking recesses 22, 32, 38 of the locking devices according to FIGS. 1, 3 and 5 have the function of holding the arms 12, 24, 34 not only in frictional engagement, but also provide a formlocking connection, so that the removal of the locking device from the closed position requires a certain force to be exerted.

FIG. 4 shows an arrangement of a plurality of like locking devices 35 of FIG. 5 similarly to the arrangement of FIG. 2. The cover 2 has a size which cannot be utilized when using a single locking device as with the openings according to FIGS. 1, 3 and 5, because they would have a more solid construction and would therefore involve higher material expenditure.

In place of the locking device 35 used in FIG. 4, it would also be possible to use locking devices 24. However, then corresponding guide links 30 would have to be used in place of guide links 40.

Figure 6B:
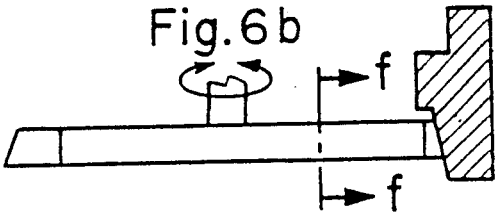
Figure 6C:
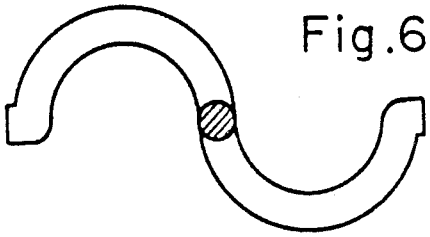
Figure 6D:
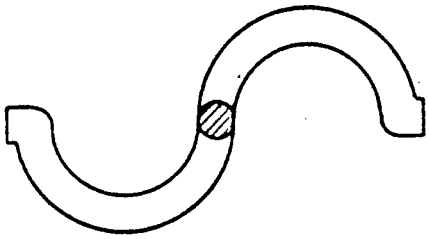
Figure 6E:
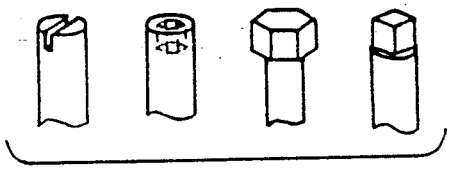
Figure 6F:
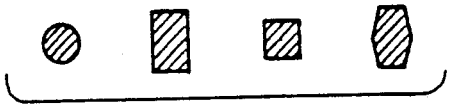

In all the drawings the mounting rod 14 is shown with the bearing and actuating device 15. This is not necessary and instead e.g. different heads 16 could be used, which, in place of an external hexagon, could have an internal hexagon, a crossslot, a simple screwdrive slot or a square end, cf. FIG. 6*e*.

In the case of locking device 10 of FIG. 1 the arms 12 are constructed as straight rods. However, the latter could be replaced by bend rods, the bending of which is made in a horizontal plane, cf. FIGS. 6*a* and 6*b*. The function of the locking device is the same as in FIG. 1.

Also in the case of locking devices 24 and 35, the coiled or bent arms 34 could be bent in a horizontal plane, without modifying the function of the locking device 35. However, it would be appropriate when placing the bent arms in a horizontal plane to arrange them in such a way as to form a S-shape, cf. FIGS. 6*c* and FIGS. 6*d*.

It is also obviously possible to give a different construction to the cross-section of the arms, e.g. round, rectangular, square or polygonal. These variants are shown in FIG. 6*h*.

While the foregoing description represents preferred embodiments of the present invention, it will be obvious to those skilled in the art that various changes and modifications may be made, without departing from the spirit and scope of the present invention.

What is claimed is:

1. A manhole cover and frame assembly comprising:

(a) a frame insertable in an opening in the ground, and having guidelink tensioning means disposed therein;

(b) a cover with an aperture; and (c) a locking device comprising:

(i) a rod for rotatably mounting in the aperture of the cover;

(ii) actuating means connected thereto and bearing on said cover for turning said rod to secure said cover to said frame; and (iii) at least two interconnected arms extending from the rod and being made of an elastically deformable material, at least one of said arms radially compressing upon contact with the guide links tensioning means of the frame when said manhole cover is secured to said frame wherein said guide links tensioning means of the frame comprises an inner circumferential circular surface having a reducing diameter, so that upon turning of the locking device into the closed position at least one of said arms are radially compressed and elastically deformed inwardly towards the rod.

2. The manhole cover and frame assembly as claimed in claim 1, wherein said arms are arcuately-shaped.

3. The manhole cover and frame assembly as claimed in claim 1, wherein said arms are U-shaped.

4. The manhole cover and frame assembly as claimed in claim 1, wherein said rod extends along an axis, and said at least two arms extend substantially perpendicularly thereto.

5. The manhole cover and frame assembly as claimed in claim 1, wherein said arms are symmetrically shaped.

6. The manhole cover and frame assembly as claimed in claim 1, wherein at least one or said arms radially compresses inwardly towards the rod.

7. The manhole cover and frame assembly as claimed in claim 1, wherein one of said arms radially compresses inwardly towards the rod and bends downwardly upon contact with the guidelink tensioning means.

8. The manhole cover and frame assembly as claimed in claim 1, wherein said guide links tensioning means of the frame also has an inclined flank with a downwardly sloping face, so that upon turning of the locking device into the closed position at least one of said arms also bends downwardly when said cover is secured to the frame.

9. Assembly according to claim 8, wherein a locking recess is formed at an end of said circular surface, an end of the respective are befng resiliently engaged in said locking recess.

10. The manhole cover and frame assembly as claimed in claim 1, wherein said inner circumferential circular surface has a radial locking recess for holding the arm in frictional engagement when said cover is secured to the frame.

11. The manhole cover and frame assembly as claimed in claim 1, wherein said inclined flank has an axial locking recess for holding the arm in frictional engagement when said cover is secured to the frame.

12. The manhole cover and frame assembly as claimed in claim 1, wherein said cover is a grate.

13. A frame-cover assembly for covering a manhole opening, comprising a frame insertable in an opening, a cover mounted on said frame, and locking device to positively secure said cover in said frame, said locking device including a closing member, said cover including a bore, said closing member including a mounting rod rotatably mounted in said bore and a plurality of arms engageable with and held in said frame with elastic deformation of the arms, and like plurality of guide links, each arm forming with a respective guide link a form-locking connection so as to lock said cover in said frame;

said bore is provided with a shoulder, and further including actuating means having an actuating head provided with a bearing surface which is mounted in rotary manner on said shoulder;

said frame includes guide links arranged on an inside thereof; and said guide links are constructed on an inner circumferential circular surface of said frame, said circular surface having a decreasing diameter, said arms being coiled and being compressed and elastically deformed against said surface.

14. Assembly according to claim 13, wherein a locking recess is formed at an end of said circular surface, an end of the respective arm being resiliently engaged in said locking recess.

15. Assembly according to claim 13, wherein said cover is a grate.

16. A frame-cover assembly for covering a manhole opening, comprising a frame insertable in an opening, a cover mounted on said frame, and locking device to positively secure said cover in said frame, said locking device including a closing member, said cover including a bore, said closing member including a mounting rod rotatably mounted in said bore and a plurality of arms engageable with and held in said frame with elastic deformation of the arms, and like plurality of guide links, each arm forming with a respective guide link a form-locking connection so as to lock said cover in said frame;

said bore is provided with a shoulder, and further including actuating means having an actuating head provided with a bearing surface which is mounted in rotary manner on said shoulder;

said frame includes guide links arranged on an inside thereof; and said guide links are constructed as a contact surface for ends of the arms of the closing member, each contact surface of a respective guide link having an inclined flank with a diameter-decreasing inner circumference, so that said arms being bent are elastically compressed against said contact surface.

17. Assembly according to claim 16, wherein a locking recess is provided on an end of said flank, the end of the respective arm being resiliently engaged in said locking recess.

18. Assembly according to claim 17, wherein said cover is a grate.

19. Assembly according to claim 16, wherein said arms are arcuately-shaped.

20. Assembly according to claim 16, wherein said arms are U-shaped.

21. Assembly according to claim 16, wherein said arms are coil-shaped.

22. Assembly according to claim 1, wherein a locking recess is formed at an end of said circular surface, an end of the respective arm being resiliently engaged in said locking recess.

* * * * *